US005618190A

United States Patent [19]

Masuda et al.

[11] Patent Number: 5,618,190

[45] Date of Patent: Apr. 8, 1997

[54] INSULATING STRUCTURE FOR A SHIELDED CONNECTOR

[75] Inventors: Satoki Masuda; Mitsuhiro Matsumoto; Hidehiko Kuboshima, all of Shizuoka, Japan

[73] Assignee: Yazaki Corporation, Tokyo, Japan

[21] Appl. No.: 528,221

[22] Filed: Sep. 14, 1995

[30] Foreign Application Priority Data

Sep. 16, 1994 [JP] Japan ..... 6-221849
Jan. 18, 1995 [JP] Japan ..... 7-005940

[51] Int. Cl.[6] ..... H01R 13/629

[52] U.S. Cl. ..... 439/98; 439/610; 439/680

[58] Field of Search ..... 439/98, 609, 607, 439/610, 680

[56] References Cited

U.S. PATENT DOCUMENTS 4,611,878 9/1986 Hall et al. ..... 439/610
4,759,730 7/1988 Sappington et al. ..... 439/680
4,795,375 1/1989 Williams ..... 439/680

*Primary Examiner*—P. Austin Bradley
*Assistant Examiner*—T. C. Patel
*Attorney, Agent, or Firm*—Sughrue, Mion, Zinn, Macpeak & Seas

[57] ABSTRACT

To make the fitting of a pair of connectors smooth and keep an insulation distance between a terminal and a metal shell large and thus improve the fitting characteristics and the reliability of a shielded connector, a rib projects over the end surface of one of a male or a female connector so that the rib lies between a metal shell projecting over the end of the male connector and a male terminal projecting over the end surface. A groove corresponds to the rib and is formed in the top end surface of the other of the male and female connectors.

6 Claims, 11 Drawing Sheets

INSULATING STRUCTURE FOR A SHIELDED CONNECTOR

BACKGROUND OF THE INVENTION

1. Field of the Invention

The present invention relates to an insulating structure for a shielded connector which reduces noise, for example, in an electric car, and particularly relates to an improvement of insulation between a metal shell covering a connector housing and a terminal.

2. Description of the Related Art

In a shielded connector, the connector is covered with a conductive cover (hereinafter referred to as "metal shell") so as to shield an internal conductor (terminal) from external electric fields, thereby preventing electromagnetic wave faults, i.e., noise. An example of such a shielded connector, in which an inner housing and an outer housing are separated from each other and assembled, will be described with reference to FIGS. 19 and 20. FIG. 19 is a longitudinal sectional view of a conventional shielded connector in which male and female connectors are fitted to each other, and FIG. 20 is a front view of a fitting surface of the male connector.

A shielded connector 1 is constituted by a male connector 3 and a female connector 5 which fit together. The male and female connectors 3 and 5 have substantially the same structure, and therefore the structure of the male connector 3 will be described by way of example.

An outer housing 7 is made from insulating resin and has an elliptic-cylindrical shape. A hollow portion 9 is defined in the outer housing 7. A circumferential wall 11 which has an elliptic-cylindrical shape is provided in the front portion of the outer housing 7 and projects therefrom. The circumferential wall 11 is fitted into a fitting groove 13 formed in the front portion of the female connector 5.

An inner housing 15 formed separately from the outer housing 7 is fitted into the hollow portion 9. A terminal reception chamber 17 is formed in the inner housing 15, and the terminal reception chamber 17 receives a terminal 23 which is connected to an insulated core 21 of a shielded wire 19. A cylindrical metal shell 25 is attached to the outer circumferential surface of the inner housing 15 to cover the inner housing 15. The rear portion of the metal shell 25 is connected to a shielded braid 27 of the shielded wire 19 by solderless contact, or the like. The inner housing 15 is covered with the metal shell 25, and fitted into the hollow portion 9, thus being installed in the outer housing 7. After installation, the metal shell 25 projects from the end surface of the inner housing 15. In the male connector 3, therefore, an electric connection portion 23*a* of the terminal 23, the metal shell 25 and the circumferential wall 11 project in this order from the center of the end surface. The shielded wire 19 is inserted through a waterproof seal member 29 so that the waterproof seal member 29 seals the gap between the hollow portion 9 and the shielded wire 19 in a water-tight fashion.

The male connector 3 is fitted to the female connector 5 which is constructed in substantially the same manner as the male connector 3, at their respective end portions. That is, when the male connector 3 is fitted into the female connector 5, the terminal 23 is inserted into a terminal 31 of the female connector 5 so that the inner housing 15 of the male connector 3 and an inner housing 33 of the female connector 5 are brought into contact at their end portions. At the same time, the circumferential wall 11 of the male connector 3 is inserted into a fitting groove 13 of the female connector 5. At that time, the metal shell 25 projecting over the top end surface of the male connector 3 is fitted into the inner circumference of a metal shell 35 projecting over the end surface of the female connector 5 in the same manner as the male connector 3.

Consequently, the inner housings 15 and 33 are covered with the metal shells 25 and 35 connected to the shield braid 27, so that inner conductors are shielded from an external electric field to prevent electromagnetic noise.

However, because the metal shell 25 surrounds the terminal 23 on the outer circumference of the inner housing 15 and projects therefrom into the conventional shield connector 1, the terminal 23 and the metal shell 25 are disposed parallel to each other and oppose each other through a short distance, or gap 37, between the end contact surfaces of the inner housings 15 and 33, when the male and female connectors 3 and 5 are fitted to each other. As a result, when a voltage is applied to the terminal 23, there is a possibility that discharge in the air will arise across the gap of 37 between the contact surfaces, and there is also the possibility that water may enter the gap 37 when the terminal 23 and the metal shell 25 are brought into an electrically conductive, thereby causing a short-circuit.

In addition, since the outer housing 7 and the inner housing 15 are formed separately from each other, there may be relative movement therebetween. Accordingly, the metal shells 25 and 35 may hit against each other when the connectors are fitted together, so that a smooth fit cannot be obtained.

SUMMARY OF THE INVENTION

Taking the foregoing problems into consideration, the object of the present invention is to provide an insulating structure of a shielded connector by which connectors can be fitted to each other smoothly, and by which the effective insulation distance between a terminal and a metal shell can be kept large, thereby improving the fitting characteristics and increasing the reliability of the connector.

In order to attain the foregoing object, according to one embodiment of the present invention, an insulating structure is provided in a shielded connector constituted by a male connector and a female connector, wherein in each of the male and female connectors has an inner housing and an outer housing with a gap defined therebetween. A terminal reception chamber for receiving a terminal is formed in the inner housing, and a metal shell covering the terminal is inserted into the inner housing. A rib is disposed between the metal shell and a male terminal projecting over the end surface of the metal shell. The rib extends across a contact surface distance between the respective end surfaces of the inner housings which are in contact with each other when the male and female connectors are fitted to each other. A groove is formed in the end surface of the other one of the male and female connectors to receive the rib.

Another embodiment of the present invention comprises an insulating structure in a shielded connector constituted by a male connector and a female connector, wherein in each of the male and female connectors, an inner housing is provided in an outer housing with a gap defined therebetween. A terminal reception chamber for receiving a terminal is formed in the inner housing, and a metal shell covering the inner housing is inserted into the gap. An annular projecting portion surrounding a male terminal on a fitting end surface of the inner housing of the male connector is provided to project toward the female connector. A cylindrical fitting portion, to be fitted inside the annular projecting portion when the connectors are fitted to each other, is formed in the inner housing of the female connector. A female terminal in which an engagement groove is formed in the side surface is inserted into the fitting portion. A terminal engagement portion, to be bent outside the fitting portion when the female terminal is inserted into the fitting portion so as to engage with the engagement groove elastically, is formed by cutting out the circumferential wall of the fitting portion. An outer circumferential wall surrounding the fitting portion is formed in the inner housing of the female connector to thereby define a gap between the outer circumferential wall and the fitting portion in which the terminal engagement portion is bent. The annular projecting portion is fitted into the space when the connectors are fitted to each other.

When a male connector ahd a female connector are fitted to each other, a rib projecting over the female connector (or the male connector) guides the female connector (or the male connector) to the inside of a metal shell of the male connector (or the female connector). As a result, the metal shells are prevented from hitting against each other and are fitted together smoothly.

When the connectors are fitted to each other, the rib projecting over the end surface of the female connector (or the male connector) is fitted into a groove of the male connector (or the female connector), so that a terminal and a metal shell, which otherwise would be in opposition to each other through a short and straight distance between contact surfaces, are prevented from contacting each other through the straight distance between the contact surfaces by means of the rib provided across the distance between the contact surfaces. Accordingly, the only path between the contact surfaces is not direct and passes around the Outer circumference of the rib in the end direction, so that the effective insulation distance between the terminal and the metal shell is increased.

In addition, in the insulating structure in a shielded connector according to the second embodiment of the present invention, an annular projecting portion of a male connector is inserted into a bent space when the male connector and a female connector are fitted to each other, so that a terminal engagement portion is prevented from being bent. Accordingly, a female terminal can be inserted into the female connector accurately. When the female terminal is fitted halfway, the terminal engagement portion projects into the bent space. Accordingly, when the connectors are fitted to each other, the annular projecting portion is prevented from being inserted. Thus, it can be detected that the female terminal is not fully fitted in an inner housing. Further, a male terminal and a metal shell which otherwise would be opposite to each other through a short distance between contact surfaces, that is, between the end surface of a fitting portion and the end inner wall surface of the inner housing, when there is no annular projecting portion, are prevented from being in opposition to each other by the annular projecting portion provided across the distance between the contact surfaces. That is, with the annular projecting portion between the male terminal and the metal shell, the distance between the contact surfaces is not direct and passes around the outer circumference of the annular projecting portion in the end direction, so that the effective insulation distance between the male terminal and the metal shell is increased.

Preferred embodiments of an insulating structure in a shielded connector according to the present invention will be described below in detail with reference to the drawings.

DETAILED DESCRIPTION OF THE PREFERRED EMBODIMENTS

Referring to FIG. 1*a* shielded connector 41 comprises a male connector 43*a* and a female connector 43*b* which are fitted to each other at their end surfaces.

The male connector 43*a* and the female connector 43*b* respectively have elliptic-cylindrical outer housings 45*a* and 45*b* made from insulating resin, inner housings 49*a* and 49*b* formed integrally with the outer housings 45*a* and 45*b* and defining gaps 47*a* and 47*b* respectively therebetween, terminal reception chambers 51*a* and 51*b* formed in the inner housings 49*a* and 49*b* respectively, terminals 53*a* and 53*b* installed in the terminal reception chambers 51*a* and 51*b* respectively, and metal shells 55*a* and 55*b* inserted into the gaps 47*a* and 47*b* respectively. Contacts 61*a* and 61*b* are connected to shield braids 59*a* and 59*b* of shielded wires 57*a* and 57*b*, the cores of the shielded wires being connected to the terminals 53*a* and 53*b*, so that the contacts 61*a* and 61*b* contact with the metal shells 55*a* and 55*b* respectively. Waterproof seal members 65*a* and 65*b* are fitted onto the outer circumferences of the shielded wires 57*a* and 57*b* so as to seal the shielded wires 57*a* and 57*b* in electric wires insertion paths 63*a* and 63*b* respectively. Rear holders 67*a* and 67*b* are fitted to the rear portions of the electric wires insertion paths 63*a* and 63*b* to prevent the waterproof seal members 65*a* and 65*b* from falling out.

Figure 1:
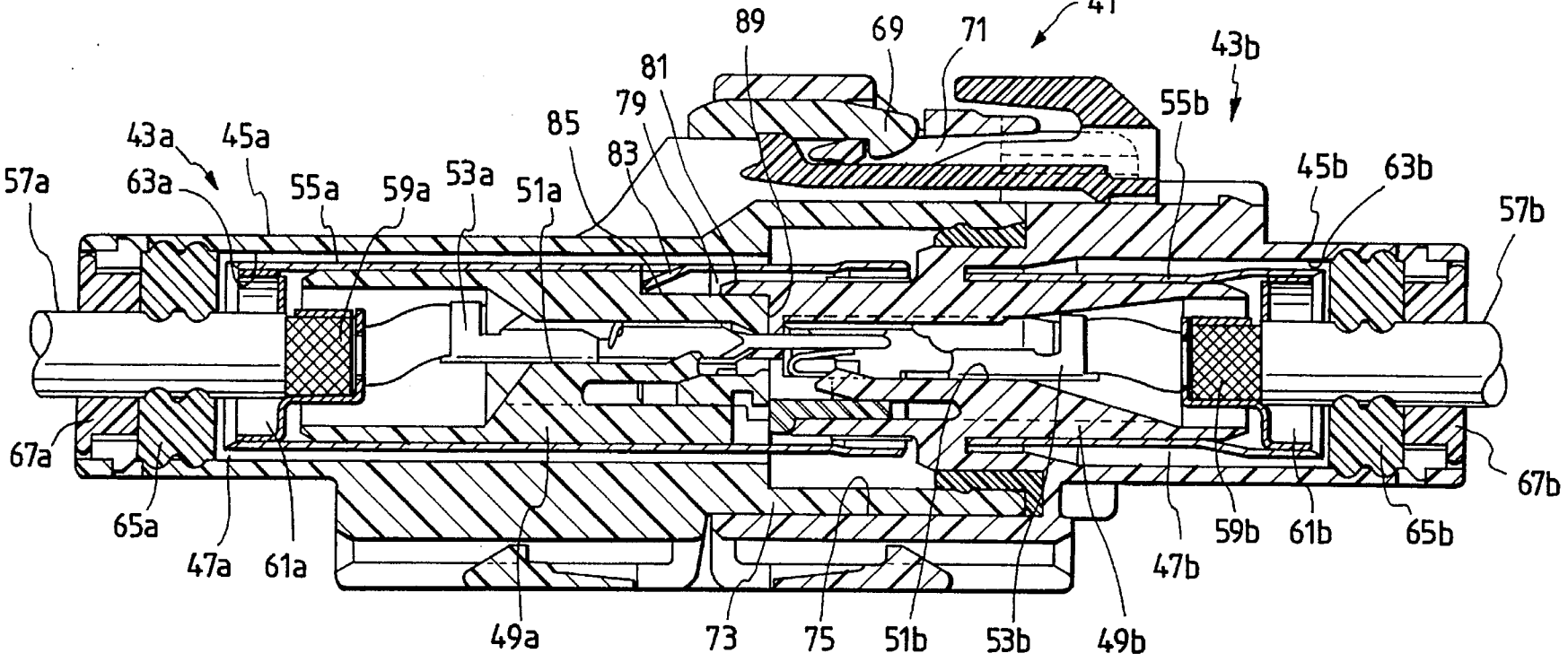
FIG. 1 is a longitudinal sectional view of a shielded connector assembly in which male and female connectors are fitted to each other, showing an insulating structure according to a preferred embodiment of the present invention.

A lock arm 69 provided outside the outer housing 45*a* of the male connector 43*a* engages with an engagement portion 71 provided outside the outer housing 45*b* of the female connector 43*b*, so that the male and female connectors 43*a* and 43*b* are fitted and secured to each other as shown in FIG. 1. A circumferential wall 73, which has an elliptic-cylindrical shape, is provided in the front portion of the outer housing 45*a* so as to project therefrom. The circumferential wall 73 is fitted into a fitting groove 75 formed in the front portion of the outer housing 45*b*.

Figure 3:
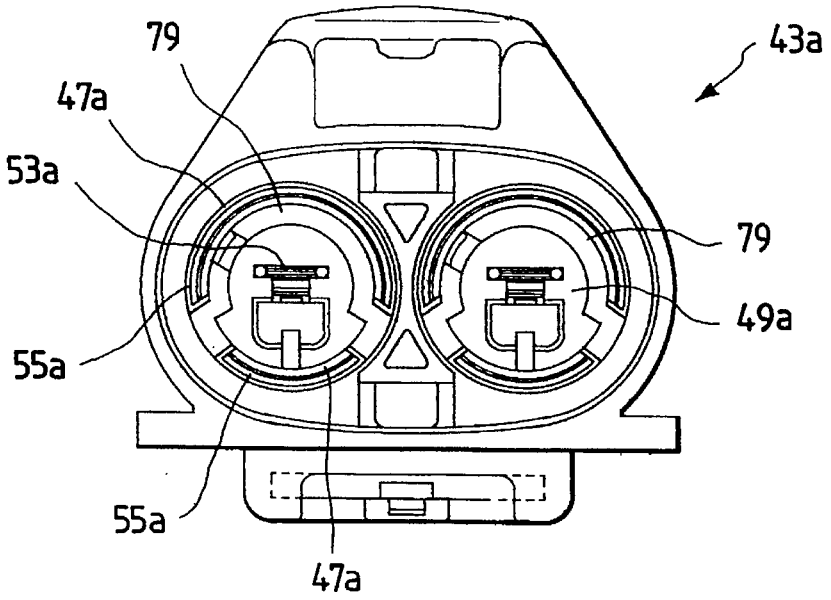
FIG. 3 is a front view of a fitting surface of the male connector.

The gap between the outer housing 45*a* and the inner housing 49*a* is an approximately half-annular shape divided into two, portions (upper and lower) as shown in FIG. 3. The metal shell 55*a*, the top end portion of which is half-annular, projects into the gap 47*a*, and the terminal 53*a* projecting into the terminal reception chamber 51*a* is surrounded by the metal shell 55*a* from above and below. On the other hand, as shown in FIG. 4, a projecting portion 77, to be inserted inside the metal shell 55*a*, is formed at the end surface of the inner housing 49*b* of the female connector 43*b*, and the end side of the metal shell 55*b* extends around to the outer circumference of the projecting portion 77.

Figure 2:
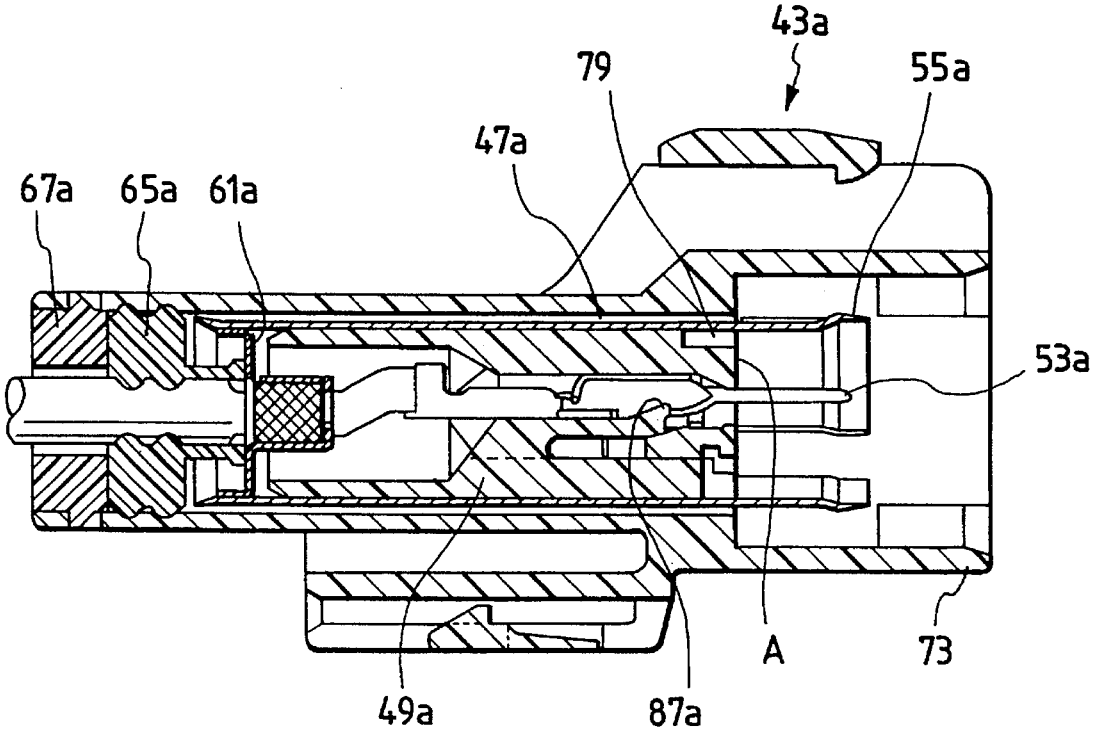
FIG. 2 is a longitudinal sectional view of the male connector.

An approximately half-annular groove 79 is formed along the gap 47*a* and between the gap 47*a* and the terminal 53*a* at the end surface of the inner housing 49*a* as shown in FIG. 2. The terminal 53*a* is eccentric in the direction upward from the center of the inner housing 49*a* (see FIG. 3), and approaches the upper part of the gap 47*a* which is divided into upper and lower parts. The groove 79 is interposed between this upper gap 47*a* and the terminal 53*a*.

Figure 4:
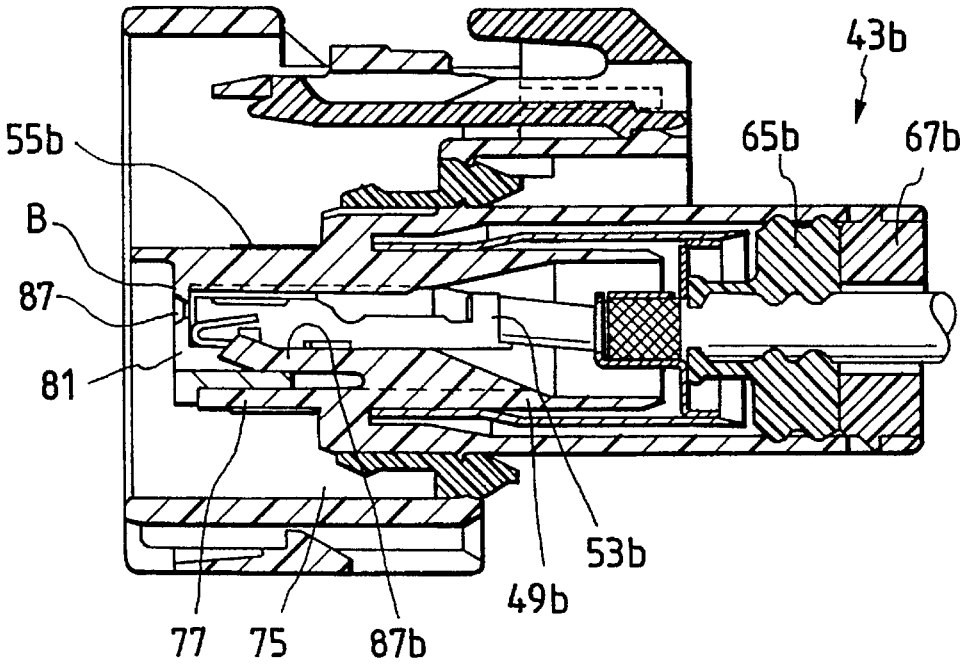
FIG. 4 is a longitudinal sectional view of the female connector.
Figure 5:
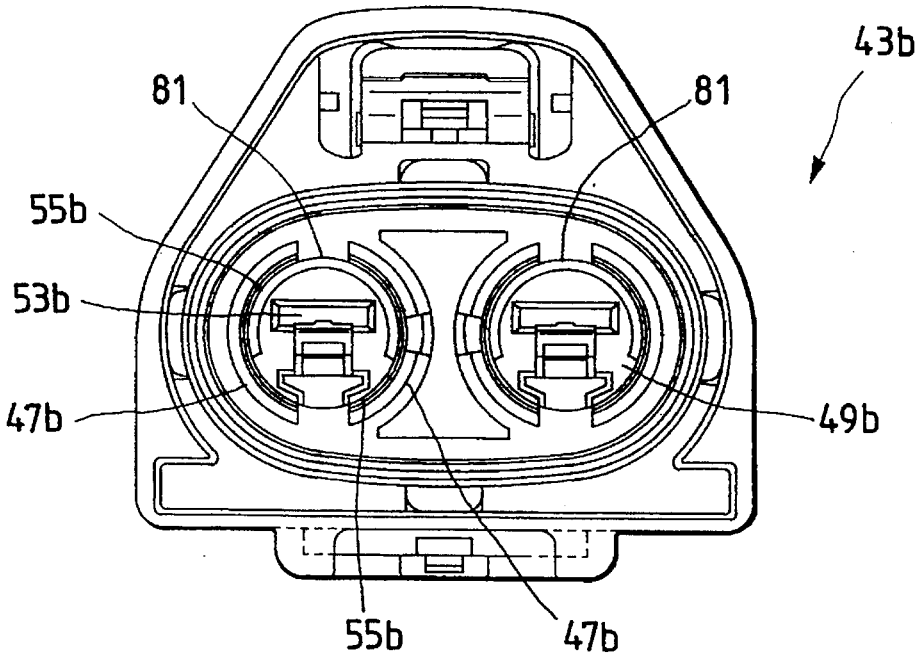
FIG. 5 is a front view of a fitting surface of the female connector.

On the other hand, as shown in FIG. 4, an approximately half-annular rib 81 (see FIG. 5) having the same shape as that of the groove 79 is provided on the outer circumference of the projecting portion 77 projecting over the end surface of the inner housing 49*b* so that the rib 81 is fitted into the groove 79 when the connectors are fitted to each other.

Assembling of the male and female connectors 43*a* and 44*b* discussed above will be described. First, the metal shells 55*a* and 55*b* are inserted to the gaps 47*a* and 47*b* defined between the inner housings 49*a* and 49*b* and the respective outer housings 45*a* and 45*b*. For example, in the case of the metal shell 55*a*, an engagement piece 83 (see FIG. 1) is made to engage with a hollow portion 85 (see FIG. 1) of the inner housing 49*a*, so that the metal shell 55*a* is fitted on the inner housing 49*a*.

Next, the terminals 53*a* and 53*b* are connected to the cores of the shielded wires 57*a* and 57*b* by a solderless connection, or the like, and at the same time, the shield braids 59*a* and 59*b* are clamped by the contacts 61*a* and 61*b* and inserted into the terminal reception chambers 51*a* and 51*b* of the male and female connector 43*a* and 43*b* respectively. At that time, the terminals 53*a* and 53*b* are engaged with the elastic engagement pieces 87*a* and 87*b* (see FIGS. 2 and 4) provided in the terminal reception chambers 51*a* and 51*b*. At the same time, the contacts 61*a* and 61*b* are fitted into the rear portions of the metal shells 55*a* and 55*b*, and the metal shells 55*a* and 55*b* are electrically connected to the shield braids 59*a* and 59*b* through the contacts 61*a* and 61*b*.

Finally, after the waterproof seal members 65*a* and 65*b* fitted to the outer circumferences of the shield wires 57*a* and 57*b* are inserted into the electric wire insertion paths 63*a* and 63*b*, the rear holders 67*a* and 67*b* are fitted into the rear portions of the electric wire insertion paths 63*a* and 63*b*, to complete assembly of the male and female connectors 43*a* and 43*b*.

The assembled male and female connectors 43*a* and 43*b* are mated to each other by inserting the circumferential wall 73 of the male connector 43*a* into the fitting groove 75 of the female connector 43*b*. When the connectors are fitted together, the rib 81 projecting from the female connector 43*b* guides the female connector 43*b* to the inside of the metal shell 55*a* of the male connector 43*a*, so that the metal shells 55*a* and 55*b* do not hit against each other and the metal shells 55*a* and 55*b* are fitted to each other smoothly. The mating is performed more effectively if a tapered surface is formed on the end portion of the rib 81.

After the connectors are mated together, the terminal 53*a* of the male connector 43*a* is inserted through an insertion hole 87 (see FIG. 4) in the end surface of the projecting portion 77 of the female connector 43*b*, and electrically connected to the terminal 53*b*.

The projecting portion 77 is inserted into the metal shell 55*a* of the male connector 43*a* so that the metal shell 55*a* is continuously connected, i.e., connected over a relatively large area, to the metal shell 55*b* disposed on the outer circumference of the projecting portion 77. That is, the terminals 53*a* and 53*b* are surrounded by the metal shells 55*a* and 55*b*.

Figure 19:
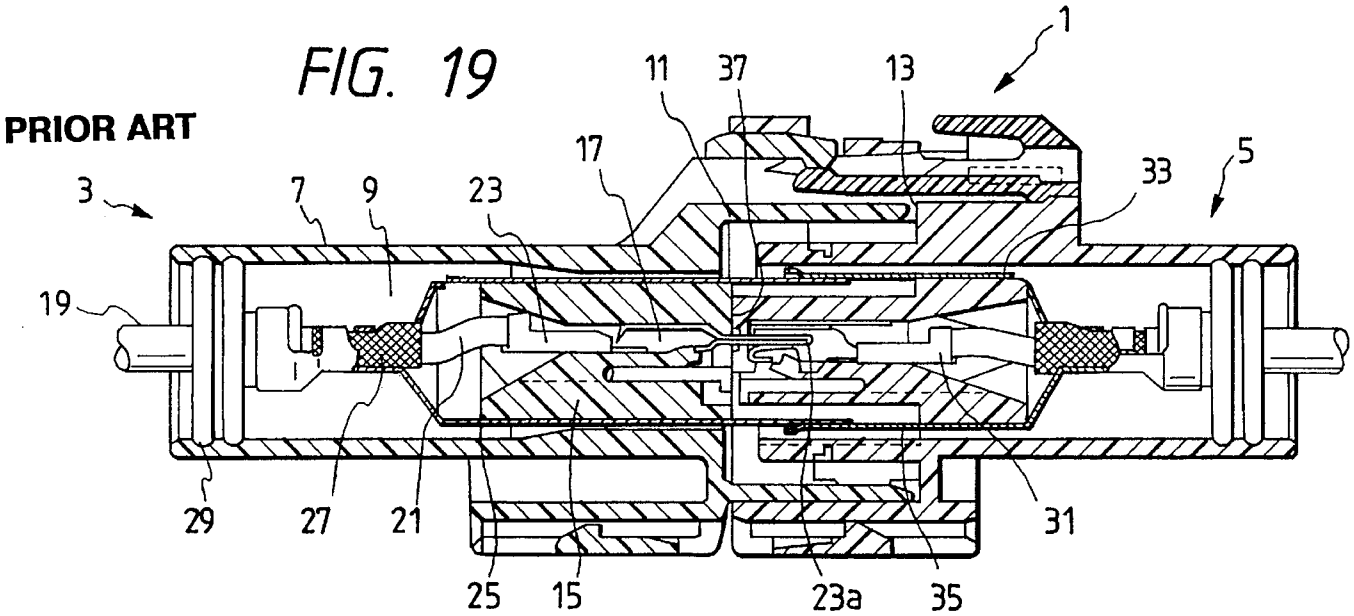
FIG. 19 PRIOR ART
FIG. 19 is a longitudinal sectional view of a conventional shielded connector assembly.
Figure 20:
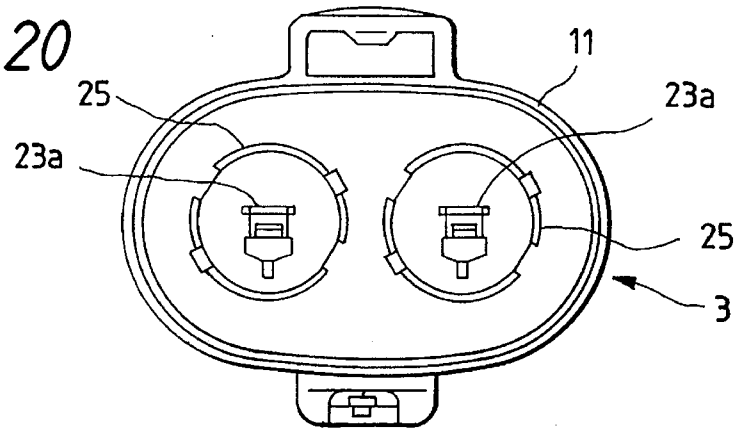
FIG. 20 PRIOR ART
FIG. 20 is a front view of a fitting surface of a male conventional connector.

At this time, the rib 81 projecting from projecting portion 77 is fitted into the groove 79 of the male connector 43*a*. Therefore, the terminal 53*a* and the metal shell 55*a* which otherwise would have been in opposition to each other throughout a short and straight distance 37 between contact surfaces (see FIG. 19), that is, between an end surface B of the projecting portion 77 (see FIG. 4) and an end surface A (see FIG. 2) of the inner housing 49*a*, when the rib 81 is not provided, are prevented from opposing each other directly by means of the rib 81 provided across the distance between the contact surfaces. That is, because the rib 81 is interposed between the terminal 53*a* and the metal shell 55*a*, distance 89 (see FIG. 1) between contact surfaces in the insulating structure according to this embodiment is not straight and passes around the outer circumference of the rib 81 in the top end direction, so that the effective insulation distance between the terminal 53*a* and the metal shell 55*a* can be relatively large. In other words, only a tortuous path is provided between these two elements.

Although in this embodiment the rib 81 is provided in the female connector 43*b* while the groove 79 is provided in the male connector 43*a*, the groove 79 and the rib 81 may be formed in the opposite connectors respectively as long as the rib 81 can lie in the path between contact surfaces.

Next, another embodiment of an insulating structure in a shielded connector according to the present invention will be described with reference to FIG. 6.

A connector 101 is constituted by a male connector 105*a* receiving a male terminal 103*a*, and a female connector 105*b* receiving a female terminal 103*b*. The male and female connectors 105*a* and 105*b* are perpendicularly fitted to each other, that is, in an L-shape or elbow configuration. Therefore, a shielded wire 107 connected to the male terminal 103*a* is connected to the female terminal 103*b* in a 90 degree L-shape. After the structure of the male connector 105*a* is described, the structure of the female connector 105*b* will be described.

Figure 8:
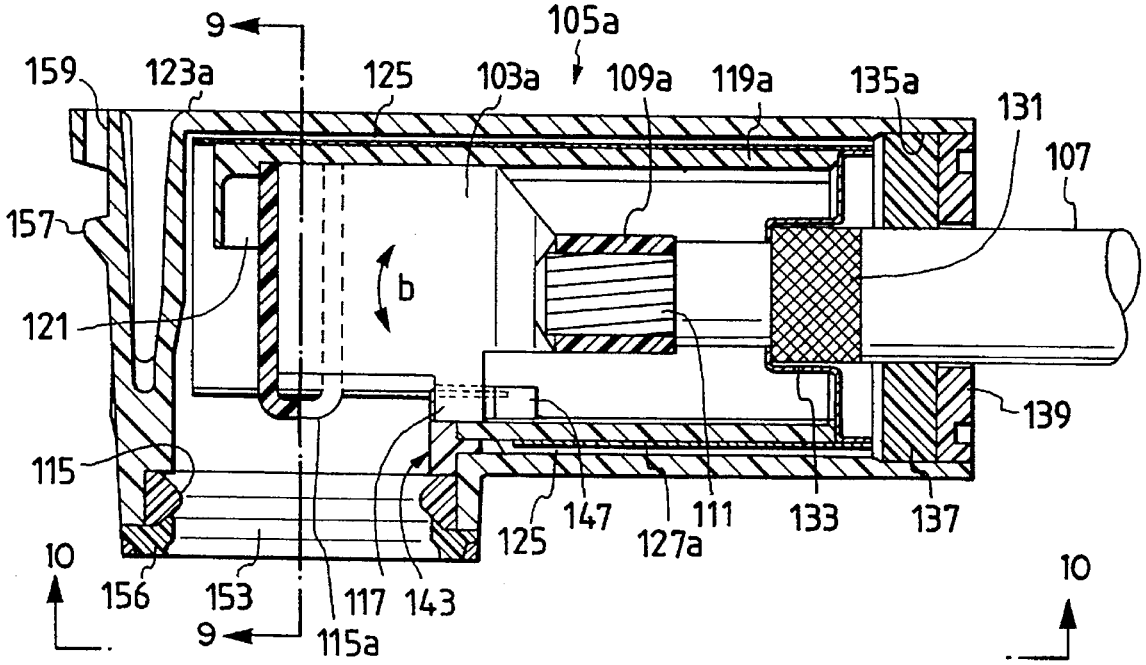
FIG. 8 is a sectional view of a male connector.
Figure 11:
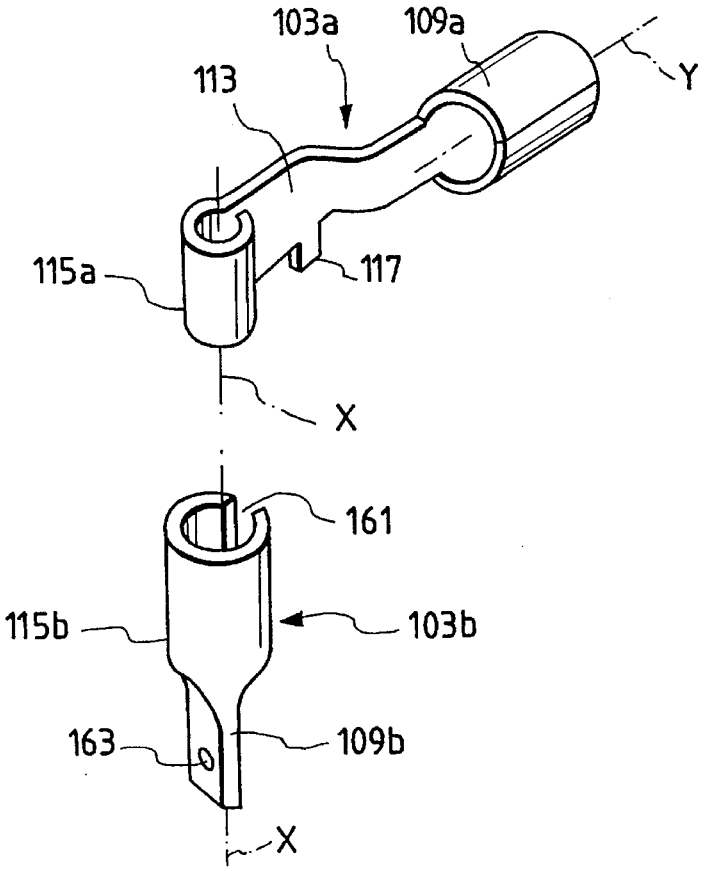
FIG. 11 is a perspective view of male and female terminals.

As shown in FIG. 11, a circular cylindrical electric wire connection portion 109*a* is formed at the base end of the male terminal 103*a*, and the electric wire connection portion 109*a* is connected to a core 111 of a shielded wire 107 (see FIG. 8). A plate-like elongated portion 113 is formed in the front portion of the electric wire connection portion 109*a*, and the elongated portion 113 is elongated in the direction of the central axis y of the electric wire connection portion. A circular cylindrical electric contact portion 115*a* is formed at the top end of the elongated portion 113, and the electric contact portion 115*a* is formed so that its central axis x is perpendicular to the central axis y of the electric wire connection portion 109*a*. A swing-stop projecting portion 117 extends vertically from the lower edge of the elongated portion 113.

Figure 12:
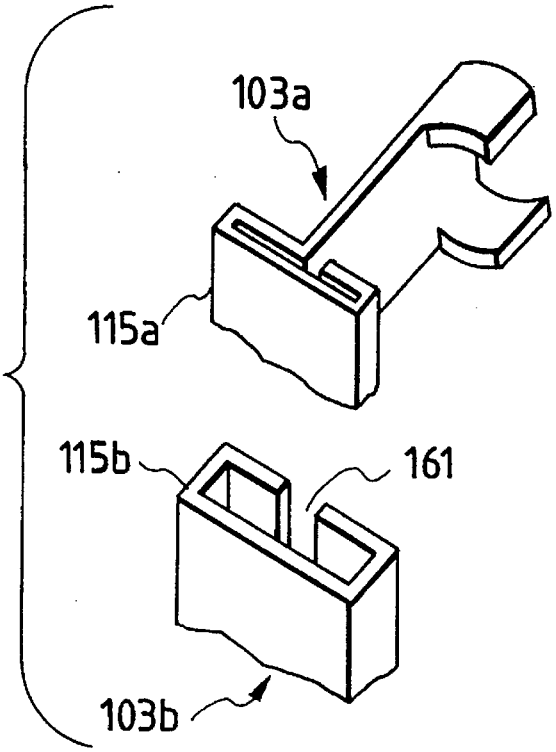
FIG. 12 is a perspective view of a modification of the male and female terminals.

Although the male terminal 103*a* of the preferred embodiment has an electric contact portion 115*a* that is cylindrical and circular in cross-section, the male terminal 103*a* may have any shape, for example, a prism-like cylindrical shape as shown in FIG. 12.

The male terminal 103*a* is inserted into a cylindrical inner housing 119*a* which is made from insulating resin. Both ends of the inner housing 119*a* are open as shown in FIG. 8. When the male terminal 103*a* is inserted into the inner housing 119*a*, the electric contact portion 115*a* projects out of the end of the inner housing 119*a*. A rib (hereinafter referred to as "annular projecting portion") 121 extends vertically downward (in FIG. 8) from the upper portion of the inner housing 119*a*, and the annular projecting portion 121 surrounds the upper portion of the electric contact portion 115*a* (see FIG. 10). An outer housing 123*a* made from insulating resin is provided outside the inner housing 119*a*, so that a gap 125 is defined between the inner housing 119*a* and the outer housing 123*a*. The inner housing 119*a* and the outer housing 123*a* may be formed integrally with each other, or may be formed separately from each other and attached to each other.

Figure 13:
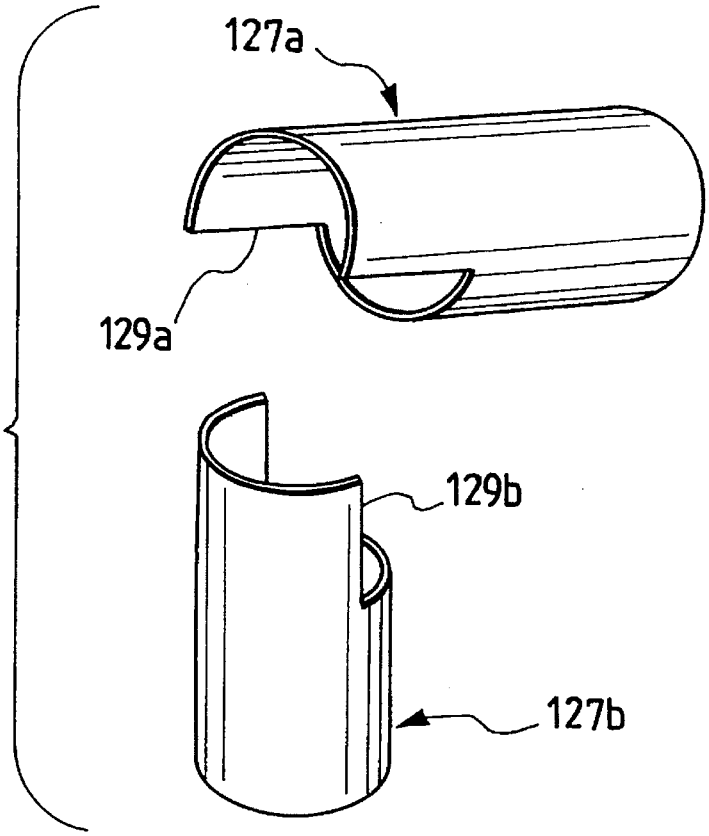
FIG. 13 is a perspective view of a metal shell.

A cylindrical metal shell 127*a* shown in FIG. 13 is inserted into the gap 125, and thee metal shell 127*a* shields the inner housing 119*a* from external electric fields. A notch 129*a* is formed in the lower end portion of the metal shell 127*a*, and the notch 129*a* corresponds to a notch 129*b* of a metal shell 127*b* of the female connector 105*b* which will be described later. The rear portion of the metal shell 127*a* is exposed on the inner circumferential side of the outer housing 123*a*. The exposed rear portion of the metal shell 127*a* is connected to a shield contact 133 which is connected to a shield braid 131 of the shielded wire 107 by solderless connection, or the like.

The shielded wire 107 connected to the male terminal 103*a* and the metal shell 127*a* is led out through a terminal insertion hole 135*a* opened in the rear portion of the outer housing 123*a*. An annular rubber stopper 137 is attached to the shielded wire 107, and the outer circumference of the rubber stopper 137 contacts the terminal insertion hole 135*a* tightly to prevent water and dust from entering between the shielded wire 107 and the terminal insertion hole 135*a*. A rear holder 139 is attached to the terminal insertion hole 135*a* at the rear of the rubber stopper 137, and the rear holder 139 prevents the rubber stopper 137 from falling.

Figure 9:
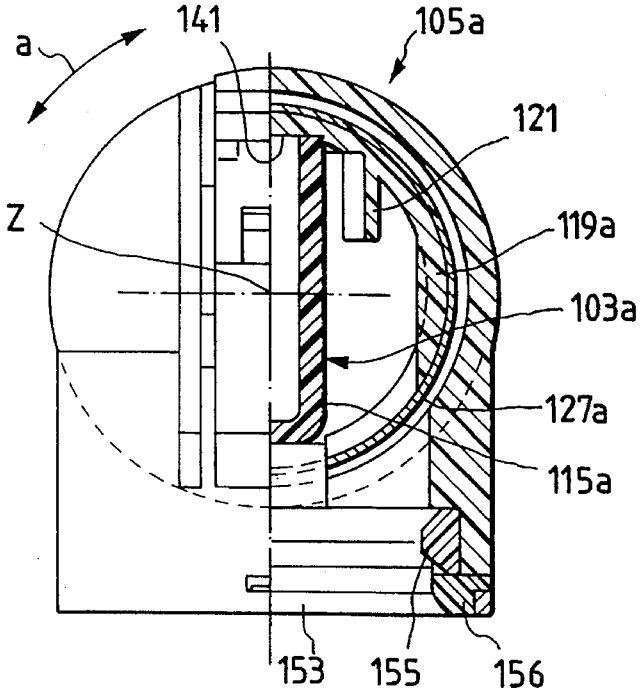
FIG. 9 is a sectional view taken on line B—B in FIG. 8.

As shown in FIG. 9, rotation prevention groove 141 which extends in the terminal insertion direction is formed in the inner wall upper portion of the inner housing 119*a*, and the rotation prevention groove 141 is fitted to the upper edge of the male terminal 103*a*. Thus, the male terminal 103*a* is limited in its rotation in the rotation direction of the arrow a in FIG. 9 about the terminal insertion axis z by the insertion of its upper edge into the whirl-stop groove 141.

Figure 14:
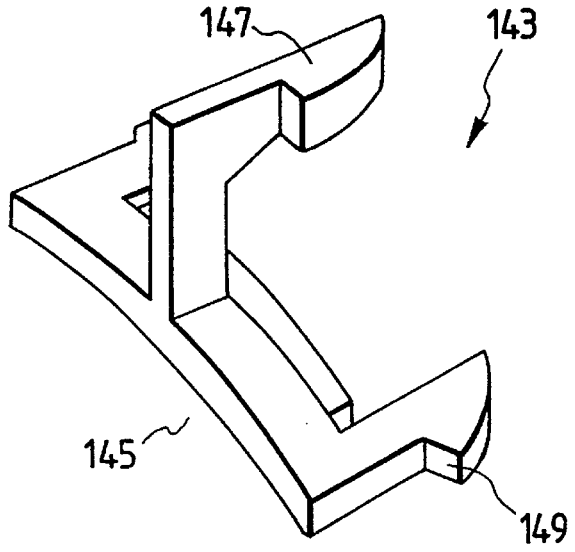
FIG. 14 is a perspective view of a spacer.

A spacer 143, best shown in FIG. 14, is fit into the gap 125 on the side opposite to the terminal insertion hole 135*a*. The spacer 143 comprises a detach-stop claw 147 formed at the center of an arc substrate 145. Lock portions 149 are formed in both sides of the substrate 145 so that the lock portions 149 elastically engage with engagement portions (not-shown) provided in the gap 125. The spacer 143 is inserted through the terminal insertion hole 135*a* before the male terminal 103*a* is inserted. At this time, the spacer 143 is inserted through a spacer insertion groove 151 (see FIG. 10) in the terminal insertion hole 135*a* which serves as a guide groove. The detach-stop claw 147 of the spacer 143 engages with the swing-stop projecting portion 117 of the male terminal 103*a* which is inserted later, so that the male terminal 103*a* is restrained from coming off. The lower end of the swing-stop projecting portion 117 of the male terminal 103*a* contacts the inner wall surface of the inner housing 119*a*, so that the male terminal 103*a* is restrained from swinging in the up/down direction perpendicular to the shielded wire 107, that is, in the direction of arrow b in FIG. 8.

Figure 10:
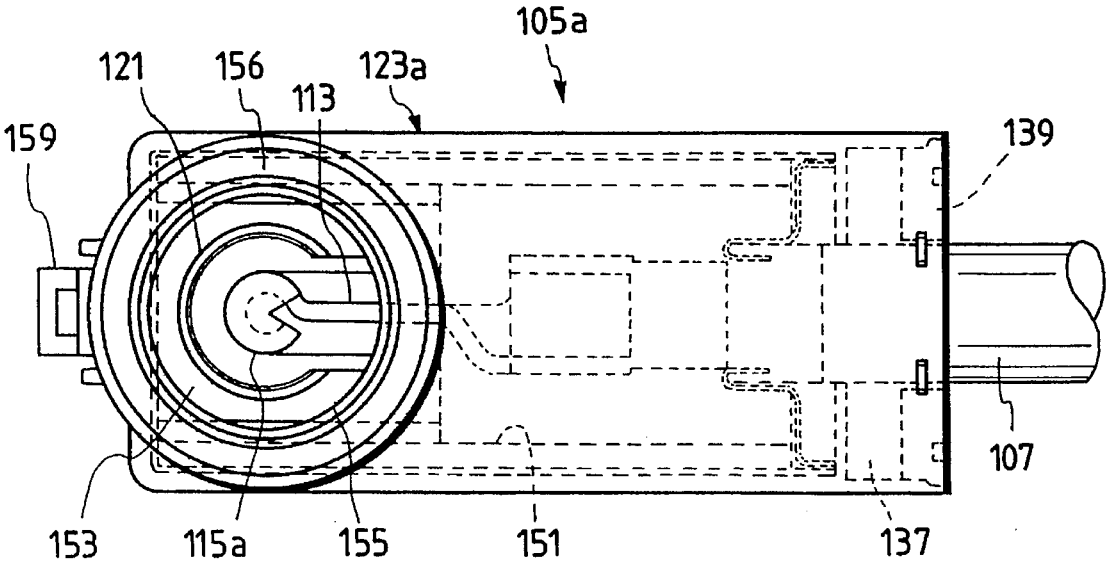
FIG. 10 is a view seen from the direction of the arrow C—C in FIG. 8.

A fitting hole 153 opened in the direction (in the lower direction in FIG. 8) perpendicular to the terminal insertion direction is formed at the end of the outer housing 123*a*, so that the central axis x of the fitting hole 153 coincides with the central axis x of the electric contact portion 115*a* (see FIG. 11). That is, as shown in FIG. 10, the annular projecting portion 121 and the electric contact portion 115*a* are disposed in the fitting hole 153 concentrically. An annular packing 155 is attached to the inner circumference of the fitting hole 153. When the male and female connectors 105*a* and 105*b* are mated to each other, the packing 155 closely contacts the female connector 105*b* which will be described later, and seals the fitting portion. A packing holder 156 is attached to the fitting hole 153 outside the packing 155, and the packing holder 156 restrains the packing 155 from coming off. As illustrated in FIG. 8, locking arm 159 having a lock portion 157 is formed in the top end outer surface of the outer housing 123*a*. When the connectors are fitted to each other, the locking arm 159 is elastically displaced to engage with a lock hole 187 of the female connector 105*b* which will be described later.

Next, the structure Of the female connector 105*b* will be described. The female connector 105*b* is a direct attachment type connector, that is, it is attached directly to a panel of a vehicle, or the like.

As shown in FIG. 11, a cylindrical electric contact portion 115*b* is formed at the top end of the female terminal 103*b*, and the electric contact portion 115*b* is disposed so that the central axis thereof coincides with the terminal insertion direction of the female terminal 103*b*. A notch 161 is formed in the electric contact portion 115*b* by cutting the circumferential wall in the central axis direction. By inserting the elongated portion 113 of the male terminal 103*a* into this notch 161, the electric contact portion 115*b* of the female terminal 103*b* fits around the electric contact portion 115*a* of the male terminal 103*a*.

A strip electric connection portion 109*b* projects over the rear portion of the electric contact portion 115*b* in the direction of the central axis x of the electric contact portion 115*b*, and the electric connection portion 109*b* has a bolt hole 163 to facilitate connection to another circuit. Similar to the above-mentioned male terminal 103*a*, the female terminal 103*b* may have not only a cylindrical shape but also other shapes, such as an angular pillar shape as shown in FIG. 12.

Figure 17:
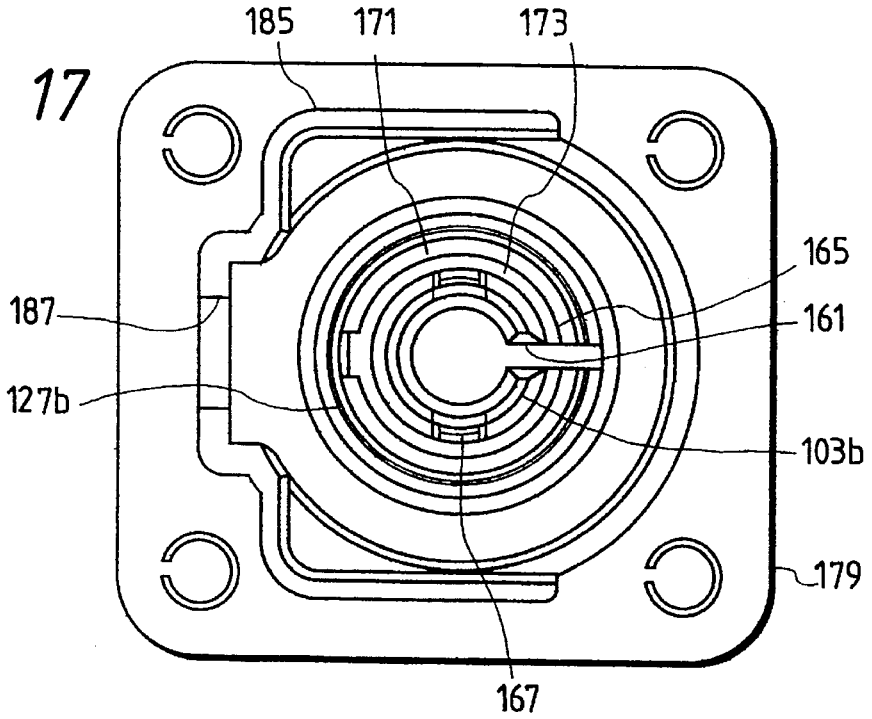
FIG. 17 is a view seen in the direction of the arrow E—E in FIG. 15.

The female terminal 103*b* is inserted into a terminal insertion hole 135*b* of a cylindrical inner housing 119*b* which is made from insulating resin. Both ends of the inner housing 119*b* are opened as shown in FIG. 6. A fitting portion 165 is formed at the top end of the inner housing 119*b*, and the fitting portion 165 is fitted into the annular projecting portion 121 of the male connector 105*a*. A flexible terminal engagement portion 167 (see FIG. 17) is formed in a portion of the fitting portion 165. After the terminal engagement portion 167 is elastically displaced outward by the insertion of the female terminal 103*b*, the terminal engagement portion 167 engages with an engagement groove 169 of the electric contact portion 115*b* (see FIG. 7). Therefore, the engagement groove 169 is engaged with the terminal engagement portion 167 so that the female terminal 103*b* is fixed in the inner housing 119*b*.

An outer circumferential wall 171 is formed outside the fitting portion 165. The gap between the fitting portion 165 and the outer circumferential wall 171 becomes a groove (hereinafter referred to as "bent space") 173 when the terminal engagement portion 167 is bent outward. The annular projecting portion 121 of the male connector 105*a* described above is inserted into this bent space 173 when the connectors are fitted together. An outer housing 123*b* made from insulating resin is provided, outside the inner housing 119*b*, and a gap 175 is formed between the inner housing 119*b* and the outer housing 123*b*. The inner housing 119*b* and the outer housing 123*b* may be formed integrally with each other, or formed separately from each other and attached by fitting engagement, or the like.

A cylindrical metal shell 127*b* shown in FIG. 13 is inserted into the gap 175, an the metal shell 127*b* shields the inner housing 119*b* from external electric fields. The inserted metal shell 127*b* extends outside the outer circumferential wall 171, and contacts the metal shell 127*a* of the male connector 105*a* when the connectors are mated to each other. An engagement claw 177 (see FIG. 15) is formed on the inner side of the top end of the metal shell 127*b*, and the engagement claw 177 engages with a step portion 178 formed in the outer surface of the fitting portion 165 o restrain the metal shell 127*b* from coming off. As shown in FIG. 13, a notch 129*b* is formed at the top end of the metal shell 127*b*, and the notch 129*b* coincides with the notch 129*a* of the metal shell 127*a* of the male connector 105*a* described above when the connectors are mated to each other.

Figure 15:
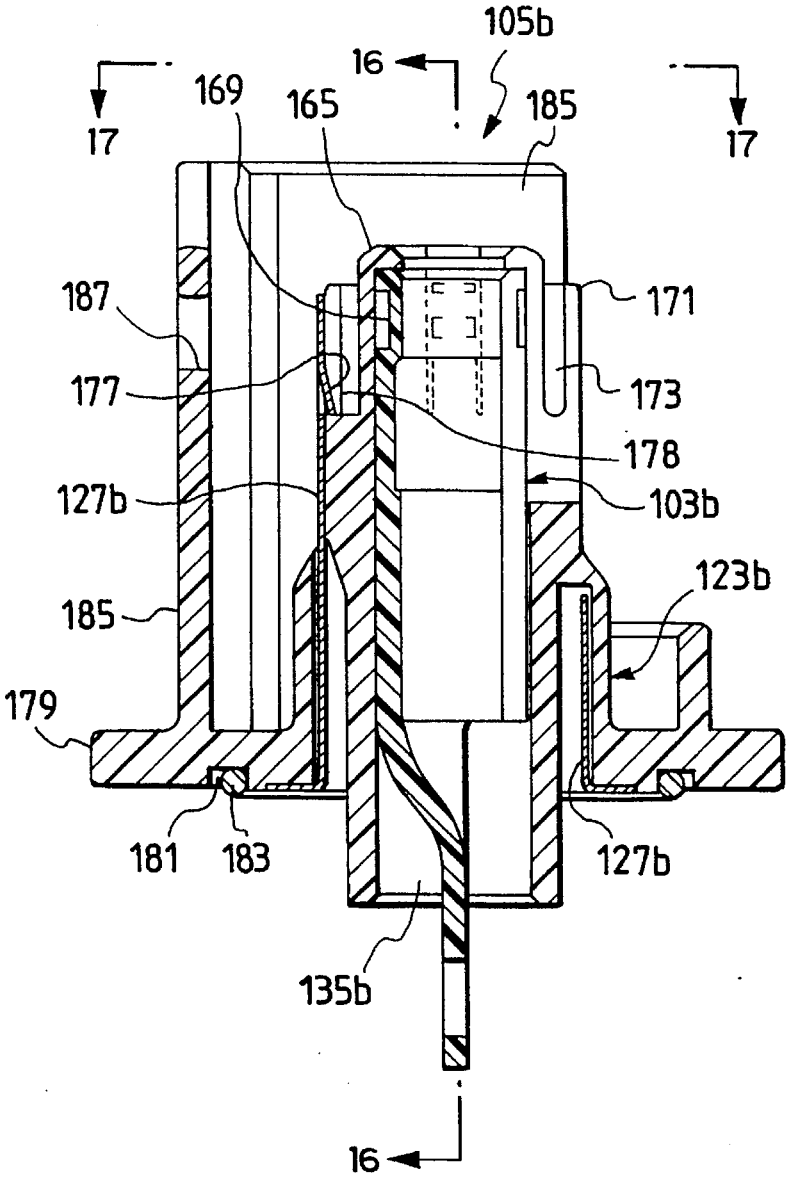
FIG. 15 is a sectional view of a female connector.
Figure 16:
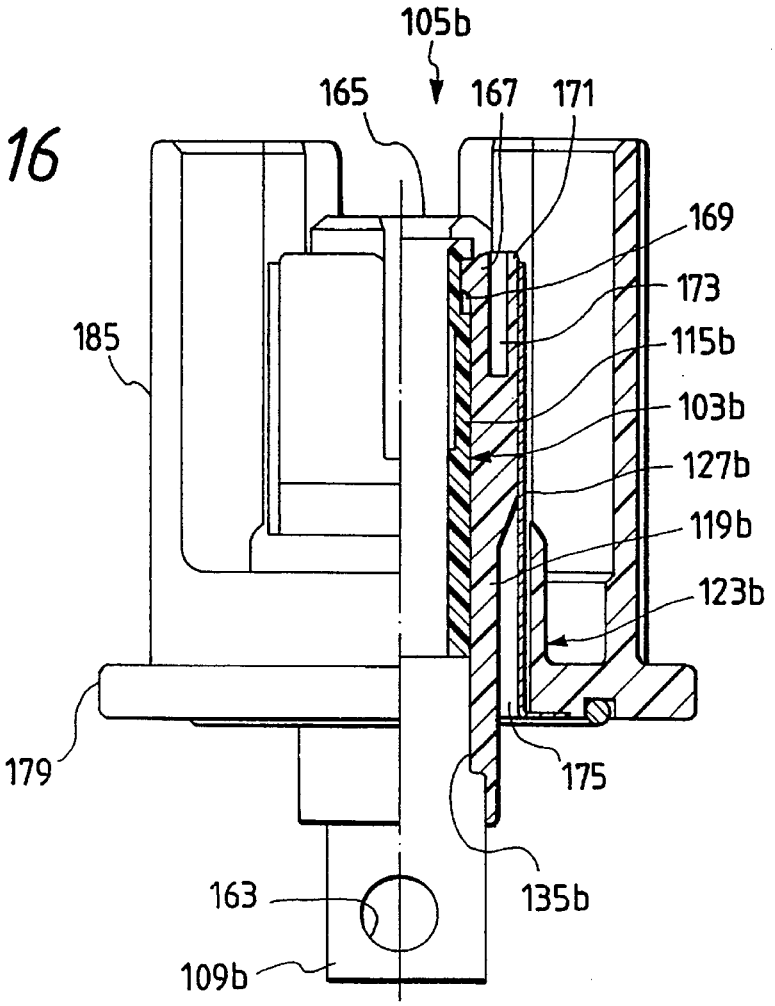
FIG. 16 is a sectional view taken on line D—D in FIG. 15.

As shown in FIG. 15, a flange portion 179 is formed in the base portion of the outer housing 123*b*, and the flange portion 179 is fixed on a panel (not-shown), or the like, of a vehicle. An annular groove 181 is formed in the panel-side surface (back surface) of he flange portion 179, and the groove 181 is formed to surround the terminal insertion hole 135*b*. An O-ring 183 is fitted in the groove 181 to seal the back surface of the flange portion 179 from the panel. The rear portion of the metal shell 127*b* is bent outward to the back surface side of the flange portion 179 and is thus exposed. The exposed rear end portion of the metal shell 127*b* is connected to a shielding circuit (not shown).

A cover portion 185 extends from the surface of the flange portion 179 to surround the outer circumferential wall 171, and the cover portion 185 is fitted to the outer circumferential portion of the fitting hole 153 of the male connector 105*a* from the outside when the connectors are fitted together. A lock hole 187 is formed in the cover portion 185, and the lock hole 187 engage with the locking arm 159 of the male connector 105*a* when the connectors are fitted together.

The operation of the connector 101 constituted by the male and female connectors 105*a* and 105*b* arranged thus when fitted to each other will be described.

Figure 6:
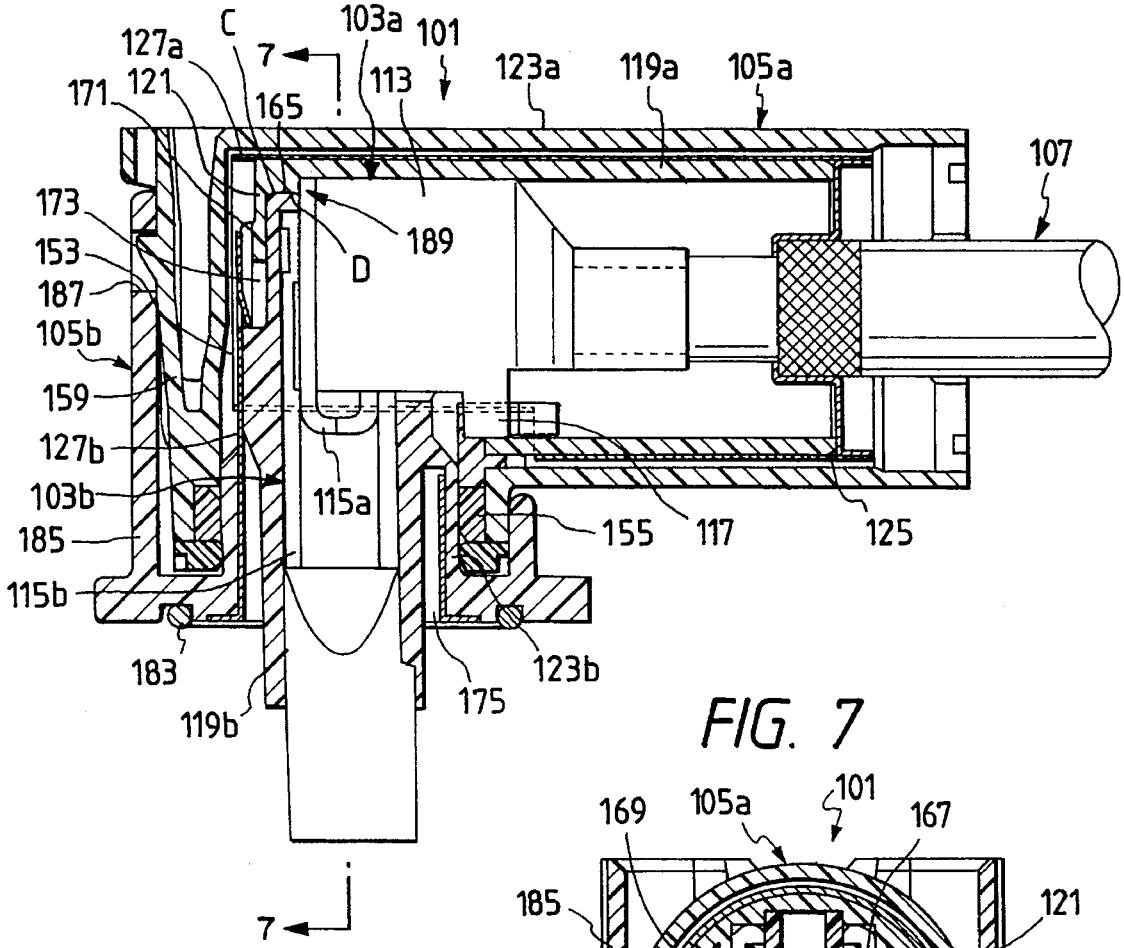
FIG. 6 is a longitudinal sectional view illustrating the fitted state of a pair of connectors, showing the insulating structure of another embodiment of the invention.
Figure 7:
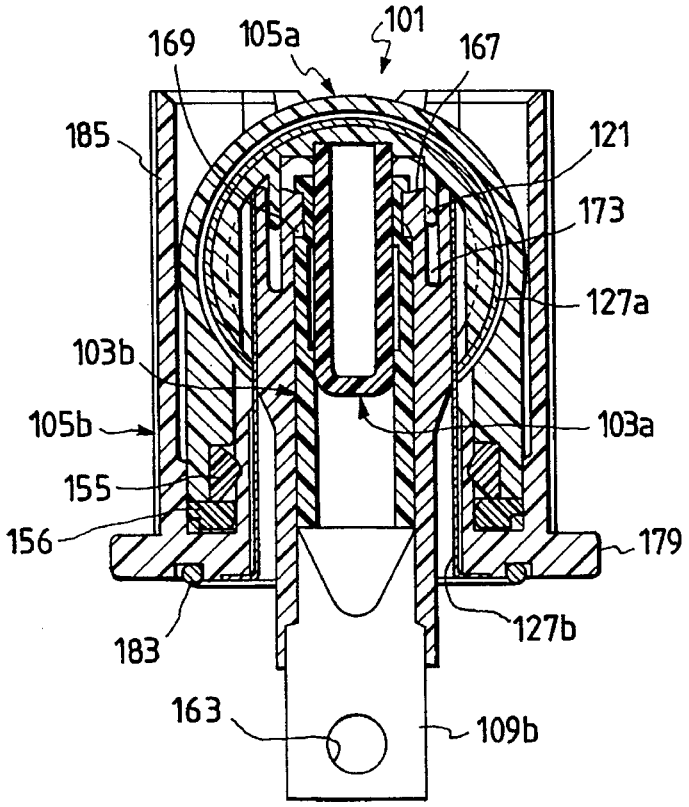
FIG. 7 is a sectional view taken on line A—A in FIG. 6.

As shown in FIG. 6, the connection of the male and female connectors 105*a* and 105*b* is performed by fitting the fitting hole 153 of the male connector 105*a* to the fitting portion 165 of the female portion 105*b*. When the fitting hole 153 and the fitting portion 165 are fitted to each other, the electric contact portion 115*a* of the male terminal 103*a* is fitted into the electric contact portion 115*b* of the female terminal 103*b*. Then, the elongated portion 113 of the male terminal 103*a* is inserted into the notch 161 (see FIG. 17) of the female terminal 103*b*, so that the two can be mated. In this state, the male and female terminals 103*a* and 103*b* are connected electrically.

At the same time, the metal shell 127*a* of the male connector 105*a* contacts the metal shell 127*b* which is exposed in the outer circumference of the inner housing 119*b* of the female connector 105*b*. Consequently, internal conductors of the inner housings 119*a* and 119*b* in the connector fitting portion are covered with the metal shells 127*a* and 127*b* which are continuously overlapped, so that the internal conductors are shielded from an external electric field.

The fitting hole 153 of the male connector 105*a* is fitted to the outer circumference of the outer housing 123*b* of the female connector 105*b*, and the packing 155 provided in the inner circumference of the fitting hole 153 tightly contacts the outer circumference of the outer housing 123*b*, so that the gap of the fitting portion between the male and female connectors 105*a* and 105*b* is sealed to prevent water and dust from entering therein.

The locking arm 159 of the male connector 105*a* engages with the lock hole 187 of the cover portion 185 of the female connector 105*b*, so that the male and female connectors 105*a* and 105*b* are locked as they are fitted to each other.

Then the insertion portion 165 of the female connector 105*b* is inserted into the annular projecting portion 121 of the male connector 105*a*, and the annular projecting portion 121 is inserted into the bent space 173 which is a gap between the fitting portion 165 and the outer circumferential wall 171. When the annular projecting portion 121 is inserted into the bent space 173, the terminal engagement portion 167 (see FIG. 7) of the female connector 105*b* is prevented from being bent outward, and locked as it engages with the engagement groove 169 of the electric contact portion 115*b*. Accordingly, the female terminal 103*b* can be inserted to the female connector 105*b* more accurately.

Since the annular projecting portion 121 is inserted into the bent space 173 of the terminal engagement portion 167, if the female terminal 103*b* is fitted halfway, the terminal engagement portion 167 projects into the bent space 173 as it is bent to prevent the annular projecting portion 121 from being inserted thereto when the connectors are fitted to each other. Consequently, it can be detected, without the need for additional parts, that the female terminal 103*b* is only partially fitted to its housing. In addition, this allows miniaturization of the housing.

Further, since the annular projecting portion 121 is fitted into the bent space 173, the male terminal 103*a* and the metal shell 127*b* which would otherwise be in opposition to each other through a short distance 189 between contact surfaces, that is, between a top end surface C of the fitting portion 165 (see FIG. 6) and a top end inner wall surface D (see FIG. 6) of the inner housing 119*a*, are prevented from being in direct opposition to each other by means of the annular projecting portion 121 disposed across the distance 189 between the contact surfaces. That is, because the annular projecting portion 121 is interposed between the male terminal 103*a* and the metal shell 127*b*, the distance 189 between the contact surfaces in the insulating structure according to the embodiment is tortuous and passes around the outer circumference of the annular projecting portion 121, so that the effective insulation distance between the male terminal 103*a* and the metal shell 127*b* is relatively large.

Figure 18:
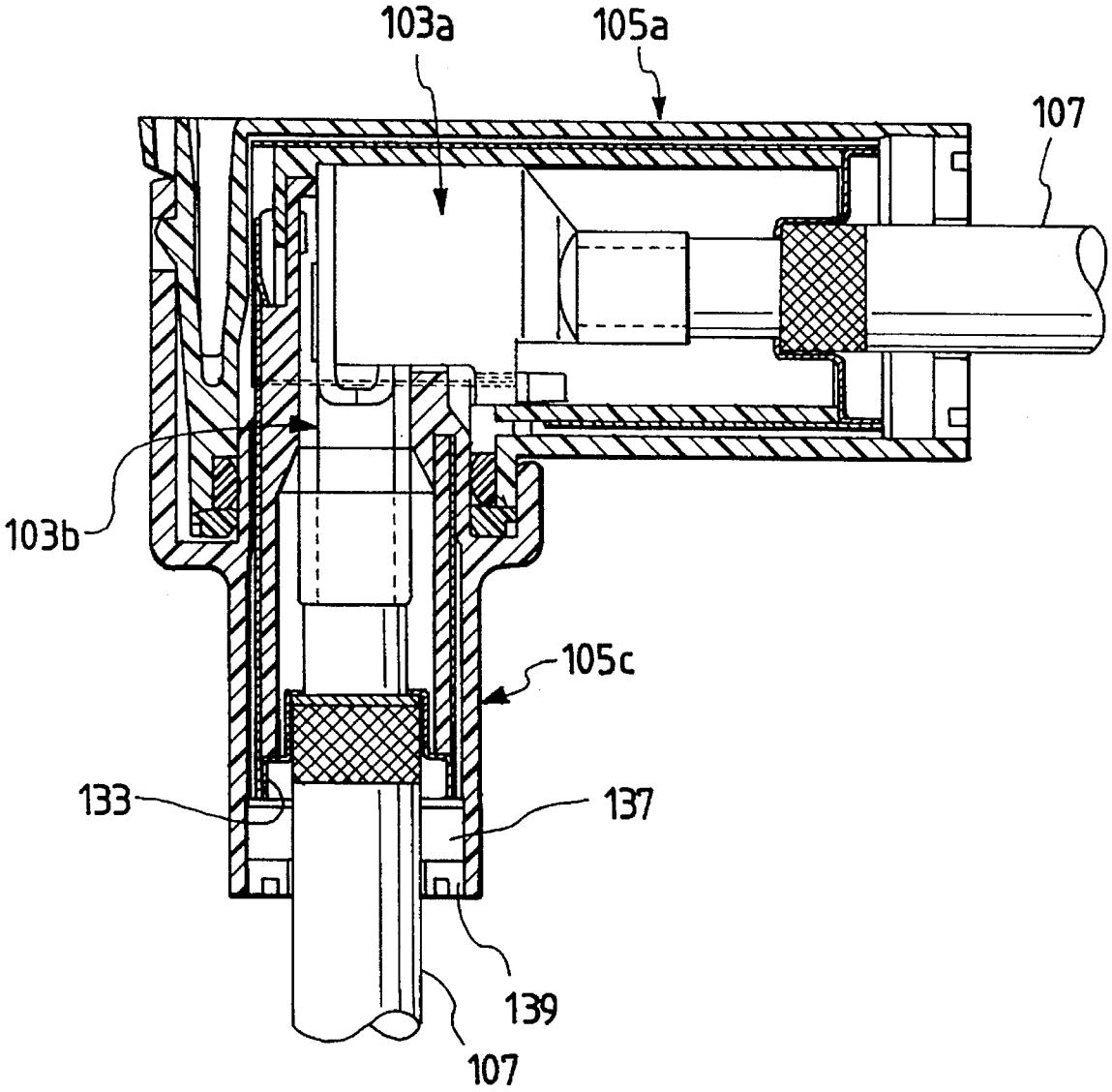
FIG. 18 is a sectional view of a connector according to a preferred embodiment of the present invention when a female connector of an electric connection type is fitted.

Although, in the preferred embodiments, the female connector 105*b* is a direct attachment type, that is, attached directly to a panel of a vehicle, or the like, the female connector 105*b* may be of a type connected to the shielded wire 107 in the same manner as the male connector 105*a* as shown in FIG. 18. In this case, a female connector 105*c* has a shield contact 133, a rubber stopper 137 and a rear holder in the same manner as the male connector 105*a* shown in FIG. 18.

As has been described above in detail, in the insulating structure in a shield connector according to the present invention, a rib which is interposed between a metal shell and a male terminal and across a distance between contact surfaces, that is, between the top end surfaces of inner housings projects over the end surface of the connector (particularly, the end surface which is the closest to a terminal insertion hole of the housing), and a groove is formed in the top end surface of another connector. Accordingly, the rib guides the connector to he inside of the metal shell when the connectors are mated, so, that the ends of metal shells do not hit against each other and the metal shells are fitted together smoothly. In addition, after the connectors are mated to each other, the rib is fitted into the groove of the other connector, so that a terminal and a metal shell are not in opposition to each other though a straight distance between contact surfaces, and the distance between the contact surfaces passes around the outer circumference of the rib, and the insulation distance between he terminal and the metal shell is large. As a result, it is possible to improve the fitting characteristics, the reliability of the connection.

In addition, in the insulating structure in the shielded connector, an annular projecting portion is provided in an inner housing of a male connector, and a fitting portion is fitted inside the annular projecting portion when the connectors are mated. A terminal engagement portion is bent outside the fitting portion and elastically engages with the fitting portion when a female terminal is inserted and is formed by cutting a circumferential wall of the fitting portion. The annular projecting portion is fitted into a bent space of the terminal engagement portion. With such a structure, the terminal engagement portion is prevented from being bent when the connector are mated to each other, so that the female terminal is inserted into the female connector accurately. When the female terminal is fitted halfway, the annular projecting portion is prevented from being inserted, so that it can be detected that the female terminal is not fitted properly. Further, a terminal and a metal shell are prevented from being in opposition to each other through a straight distance between contact surfaces by means of the annular projecting portion fitted across the distance between the contact surfaces. Accordingly, the insulation distance between the terminal and the metal shell is large and reliability is improved.

In addition, with the structure where the annular projecting portion formed in the male connector is fitted into the bent space of the terminal engagement portion of the female connector to prevent the terminal engagement portion from being elastically deformed, it is possible to omit other parts such as a spacer, and so on, used in the prior art, and therefore possible to miniaturize the connector housing.

The invention has been described through preferred embodiments. However, various modifications can be made without departing from the scope of the invention as defined by the appended claims.

We claim:

1. An insulating structure in a shielded connector assembly constituted by a first connector half and a second connector half wherein, in each of said first and second connector halves, an inner housing is provided in an outer housing and a gap is defined between the inner housing and the outer housing, a terminal reception chamber for receiving a terminal is formed in said inner housing, and a metal shell covering said inner housing is disposed in said gap, said insulating structure further comprising:

a rib disposed between said metal shell and said terminal of said first connector half, said rib projecting over an end surface of said inner housing of said first connector half and extending in parallel with said metal shell of said first connector half, said rib being disposed on a contact surface of said inner housing of said first connector half which contacts said inner housing of said second connector half when said first and second connector halves fitted to each other, and projecting over an end surface of said second connector half when said first and second connector halves are fitted to each other, and a groove formed in the top end surface of said second connector half to receive said rib when said first and second connector halves are fitted to each other.

2. An insulating structure in a shielded connector assembly according to claim 1, wherein each of said outer housings and a corresponding one of said inner housings are formed integrally with each other.

3. An insulating structure in a shielded connector assembly according to claim 1, wherein said gap is formed into an approximately half-annular shape, said groove is formed into an approximately half-annular shape in a top end surface between said gap and said terminal along said gap, and said rib is formed into an approximately half-annular shape similar to that of said groove.

4. An insulating structure in a shielded connector assembly according to claim 1, wherein said terminal projects eccentrically from the center of said one of said inner housings at said connector, and said rib and said groove are interposed between said terminal and said metal shell of said one of said inner housings on the eccentric side.

5. An insulating structure in a shielded connector assembly according to claim 1, wherein an end of said metal shell is divided into approximately half-annular shapes.

6. An insulating structure in a shielded connector assembly according to claim 1, wherein said first connector half is a female connector, and said second connector half is a male connector.

* * * * *